US011085179B1

(12) United States Patent
Cohen

(10) Patent No.: US 11,085,179 B1
(45) Date of Patent: Aug. 10, 2021

(54) SEDIMENT COLLECTION DRAIN BASKET APPARATUS

(71) Applicant: TNT Products, Inc., Simi Valley, CA (US)

(72) Inventor: Todd Russell Cohen, Simi Valley, CA (US)

(73) Assignee: TNT Products, Inc., Simi Valley, CA (US)

( * ) Notice: Subject to any disclaimer, the term of this patent is extended or adjusted under 35 U.S.C. 154(b) by 0 days.

(21) Appl. No.: 16/828,921

(22) Filed: Mar. 24, 2020

(51) Int. Cl.
*E03C 1/264* (2006.01)

(52) U.S. Cl.
CPC ..... *E03C 1/264* (2013.01)

(58) Field of Classification Search
CPC . E03C 1/264; E03C 1/26; E03C 1/262; B01D 24/004
USPC ..... 4/287, 289, 290, 291
See application file for complete search history.

(56) References Cited

U.S. PATENT DOCUMENTS 1,035,733 A * 8/1912 Pierce ..... E03C 1/264 4/291
1,450,629 A * 4/1923 Grigg ..... E03C 1/264 4/286
1,783,460 A * 12/1930 Brotz ..... E03C 1/23 4/689
2,090,299 A * 8/1937 Kuhnle ..... E03C 1/262 4/287
2,112,834 A * 4/1938 Egan ..... E03C 1/262 4/287
2,739,317 A * 3/1956 Abresch ..... E03C 1/264 4/679
2,838,769 A * 6/1958 Lengyel ..... E03C 1/262 4/287
5,369,815 A * 12/1994 Martin ..... A47K 1/14 4/287
6,108,828 A * 8/2000 Cheng ..... A47K 1/14 4/286
6,387,261 B1 * 5/2002 Mojena ..... B01D 24/008 210/315

(Continued)

*Primary Examiner* — Benjamin R Shaw
(74) *Attorney, Agent, or Firm* — Gregory B. Wood

(57) ABSTRACT

A nested drain basket apparatus for placement in an enlarged drain opening having an interior support floor, for separating and retaining debris while allowing liquid such as water to flow into the drain free of the debris includes a upper basket nested in a bottom basket. The upper and bottom baskets each have a bottom with a raised portion, and sidewall structure extending up from the bottom. The upper basket includes a plurality of upper basket openings in its bottom and sidewall structure. The bottom basket includes a plurality of bottom, basket openings in its bottom and sidewall structure where the bottom basket openings are generally smaller than the upper basket openings with the raised portion of the upper and bottom baskets each having at least one finger hole to facilitate removal of the upper basket and bottom basket for cleaning. The upper basket includes a flange at the termination of its sidewall structure and the bottom basket include a recessed ledge at the termination of its sidewall structure for receiving the upper basket flange so that upper basket is held in spaced relationship above the bottom of the bottom basket. The bottom basket further has legs for supporting the apparatus on the support floor of the drain opening.

9 Claims, 5 Drawing Sheets

(56) References Cited

U.S. PATENT DOCUMENTS

| | | | | |
|---|---|---|---|---|
| 9,021,621 | B2 * | 5/2015 | Booker, Jr. | E03C 1/262 4/287 |
| 2008/0295236 | A1 * | 12/2008 | Eichler | E03F 5/02 4/292 |
| 2016/0244955 | A1 * | 8/2016 | Allred, III | E03C 1/126 |
| 2017/0101769 | A1 * | 4/2017 | Scamuffa | E03C 1/264 |
| 2020/0217055 | A1 * | 7/2020 | Robillard | E03F 5/0407 |

* cited by examiner

SEDIMENT COLLECTION DRAIN BASKET APPARATUS

BACKGROUND OF THE INVENTION

The present invention relates to debris filtering drain assemblies and more specifically to drain apparatus which includes nested baskets for being positioned in an enlarged opening of a floor or utility sink drain at the opening of a drainpipe, the baskets nested for catching debris/sediments while allowing liquid to flow into the drain.

Filtering mechanisms positioned at drain openings to catch debris in wastewater, so as to prevent the debris from entering into or otherwise clogging drainpipes are known.

An example of a storm water filter system apparatus is disclosed in U.S. Pat. No. 7,153,417 which discloses a storm water filter system apparatus. Another example of a catch basin filtration system is disclosed in a U.S. Pat. No. 7,040,838 which shows a catch basin filtration system having a filter body dimension to fit within a drain inlet forming a trough or reservoir.

While these apparatuses are useful in collecting debris and preventing debris from entering drainpipes, there is still a need for filtering apparatus for industrial applications where the drain opening has an enlarged drain basin for directing liquid into a narrower drainpipe opening. The drain basin may be square, rectangular, round or oval shaped with the filter apparatus shaped and sized to fit in the drain basin and functions to allow debris to be captured while waste water flows into the drain thereby catching the debris in the apparatus for periodic disposal so as to prevent the debris from entering the drainpipe.

SUMMARY OF THE INVENTION

A nested drain basket apparatus for fitting into an enlarged drain opening having an interior support floor is provided for separating and retaining debris while allowing liquid such, as water to flow into the drainpipe free of the debris. The drain basket apparatus includes an upper basket nested in a lower basket. The upper and lower baskets each have a bottom with a raised portion, and sidewall structures extending up from the bottoms. The upper basket includes a plurality of upper basket openings in its bottom and sidewall structure. The lower basket includes a plurality of lower basket openings in its bottom and sidewall structure where the lower basket openings are generally smaller than the upper basket openings with the raised portion of the upper and bottom baskets each having, at least one finger hole to facilitate removal of the upper basket and lower basket for periodic removal to discard the captured debris. The upper basket includes a flange at the termination of its sidewall structure and the lower basket includes a recessed ledge at the termination of its sidewall structure for receiving the upper basket flange so that upper basket is held in spaced relationship above the bottom of the lower basket. The bottom basket further has legs for supporting the apparatus on the support floor of the drain opening.

The raised center portion of the upper basket, include three finger holes to enable the user to grasp and remove the upper basket when it is desired to empty the captured debris. The lower basket also included at least one finger hole in non-aligned orientation relative to the upper basket finger holes to facility removal of the upper basket without also removing the lower basket.

These and other features and object of the present invention will be apparent from the following detailed description, taken with reference to the accompanying drawing figures in which like features are identified by like reference numerals.

DETAILED DESCRIPTION

Figure 1:
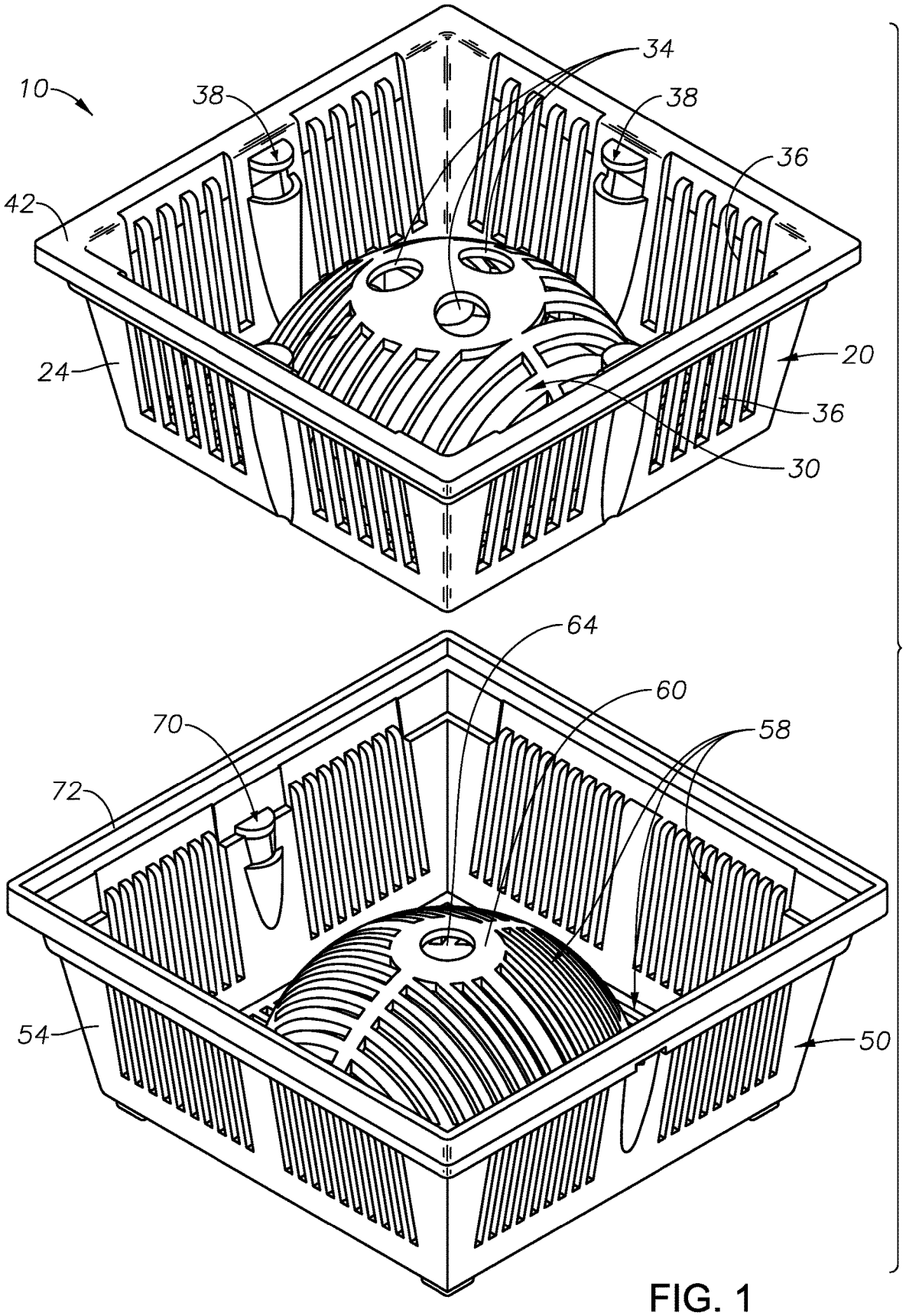
FIG. 1 is an upper perspective exploded view of the upper and bottom baskets of the nested drain basket apparatus according to a square embodiment of the present disclosure.
Figure 2:
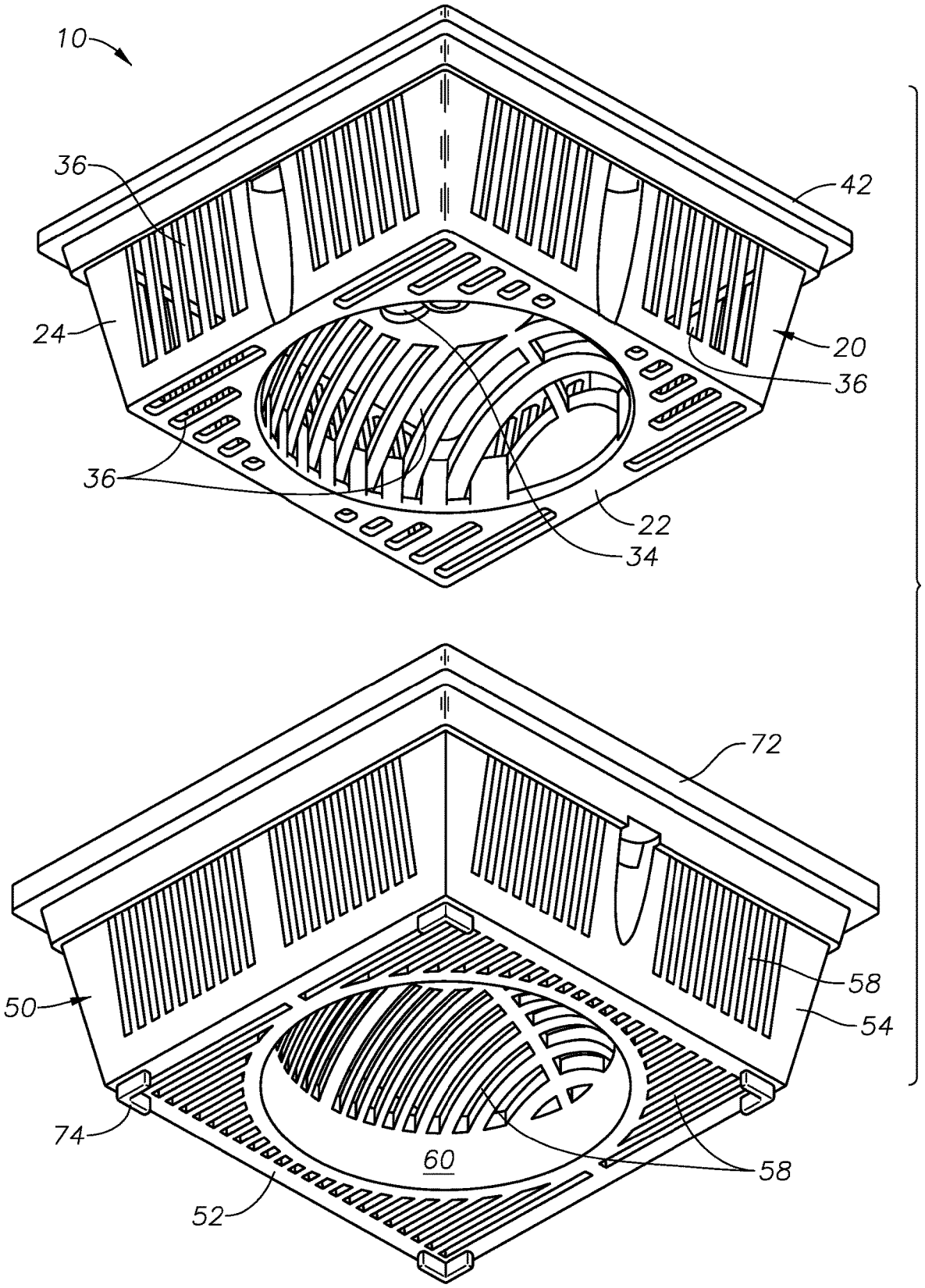
FIG. 2 is a bottom perspective exploded view of the upper and bottom baskets of the nested drain basket apparatus according to a square embodiment of the present disclosure.
Figure 3:
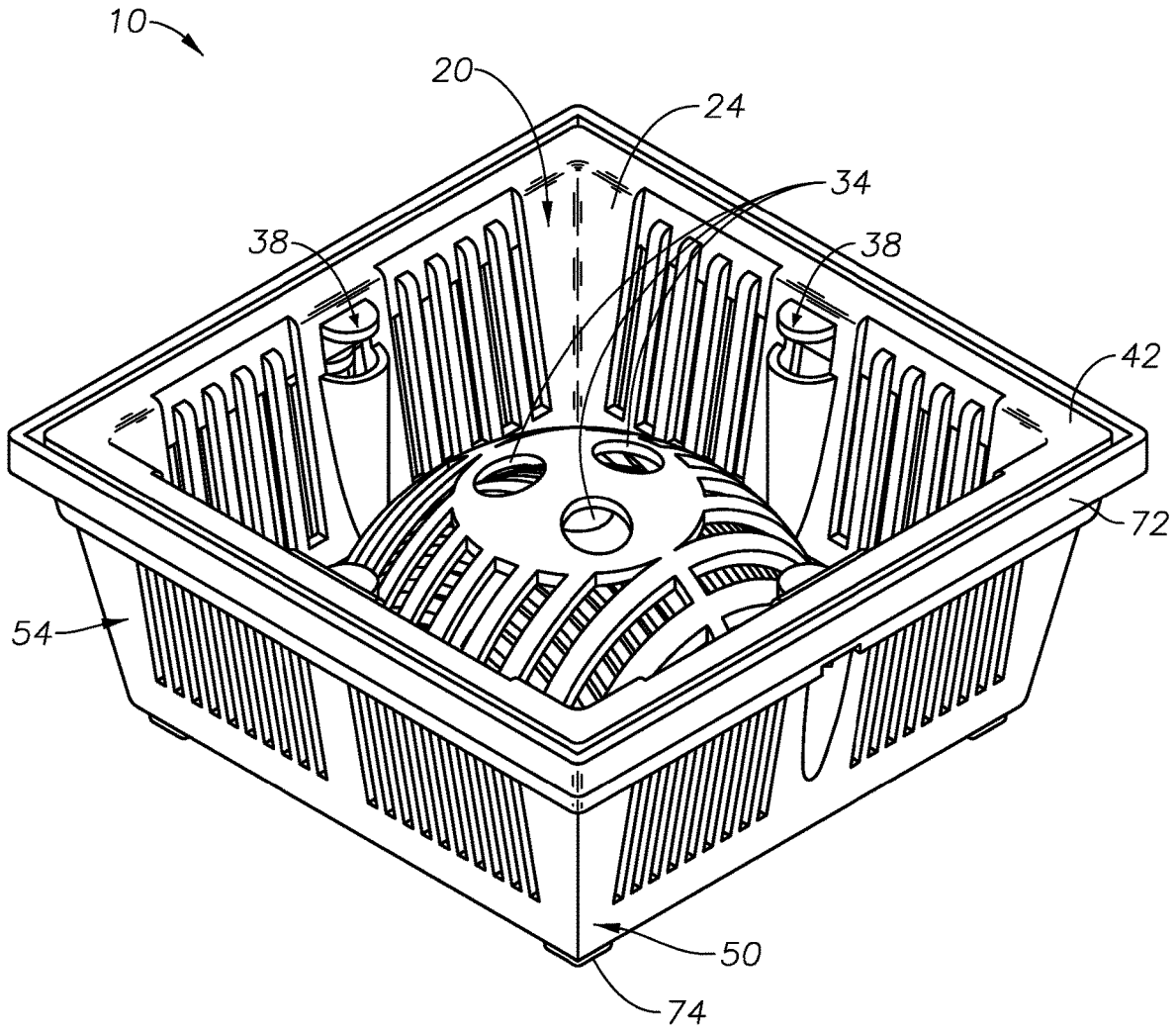
FIG. 3 is a perspective view of the assembled upper and bottom baskets of the nested drain basket apparatus according to a square embodiment of the present disclosure.
Figure 4:
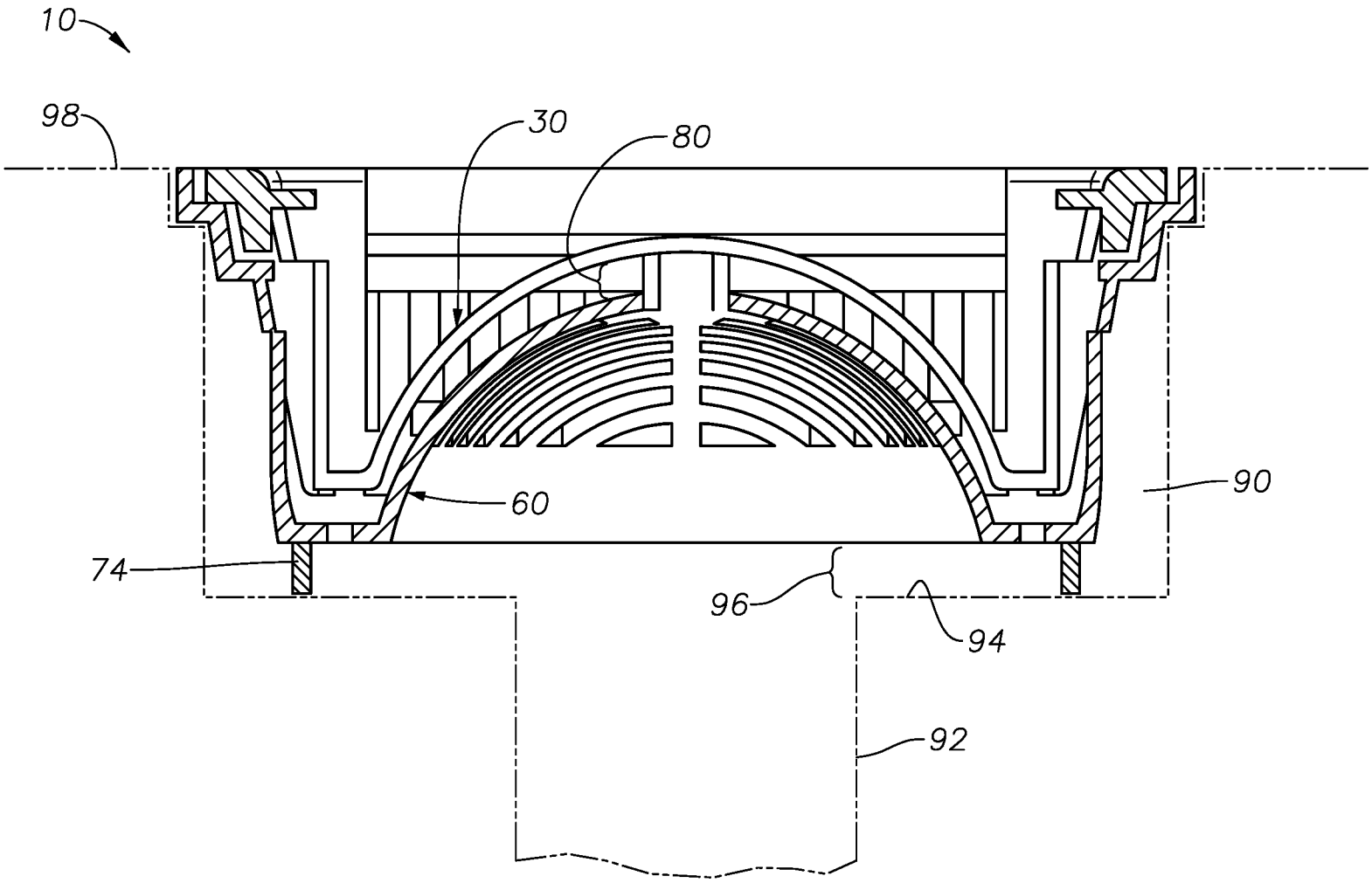
FIG. 4 is a cross-sectional view of the nested drain basket apparatus according to a square embodiment of the present disclosure.

Referring to FIGS. 1-4 a nested drain basket apparatus 10 for separating, debris from liquid flowing into a drainpipe 92 to prevent the debris from entering and clogging the drainpipe 92 is illustrated. The nested drain basket apparatus 10 is configured to fit into a drain basin 90 in a floor or sink area. Without the nested drain basket apparatus 10, the drain basin 90 functions to funnel wastewater or other liquid into the drainpipe 92 in the drain basin floor 94. The nested drain basket apparatus, when inserted in the drain basin 90, is fitted so that all debris containing water will flow exclusively through the nested drain basket apparatus 10.

The nested drain basket apparatus 10 includes an upper basket 20 removably inserted into a lower basket 50, the upper basket 20 having upper basket openings 36 through which debris containing water can flow, the upper basket 20 functioning to prevent debris in the water from entering the drainpipe 92, and the lower basket 50 having lower basket openings 58, the lower basket 50 functioning to prevent debris in the water from entering the drainpipe 92. The lower basket openings 58 are smaller than the upper basket openings 36 so that small debris able to pass through the upper basket openings 36 are also prevented from passing into the drainpipe 92 by the lower basket 50.

The upper basket 20 includes an upper bottom 22, an upper sidewall structure 24 terminating in an upper peripheral flange 42, and an upper raised portion 30 projecting upward from the upper bottom 22 of the upper basket 20. The upper basket openings 36 may be elongated slots which may extend through the upper bottom 22, the upper raised portion 30 and the upper sidewall structure 24 of the upper basket 20 to allow liquid to pass through but catch debris that would otherwise flow into the drainpipe 92 with the liquid. At the apex of the upper raised portion 30 three upper finger holes 34 are provided to enable a user to periodically lift the upper basket 20 from engagement with the lower basket 50 to remove the debris captured by the upper basket 20 while the lower basket 50 continues to prevent debris from flowing into the drainpipe 92.

The lower basket 50 includes a lower bottom 52, a lower sidewall structure 54 terminating in a lower peripheral recessed ledge 72 positioned to engage the upper peripheral flange 42 of the upper basket 20, and a lower raised portion 60 projecting up from the lower bottom 52 of the lower basket 50. The lower basket openings 58 may be elongated slots which may extend through the lower bottom 52, the lower raised portion 60 and the lower sidewall structure 54 to allow liquid to pass through but additionally catch smaller sized debris that passes through the upper basket openings 36. The lower raised portion 60 may include a single lower finger hole 64 offset from and in non-alignment with the upper finger holes 34 to allow finger access to the upper basket without giving access to the lower basket finger hole 64 and also to prevent debris from passing through the upper basket and lower basket finger holes 34 and 64. To facilitate engaging and separating the upper and lower baskets, the upper sidewall structure 24 and the lower sidewall structure 54 are each tapered inwardly and sized so that the upper basket 20 and lower basket 50 provide a first gap 80 between the upper basket 20 and lower basket 50 when they are in nested relationship.

In addition to or as an alternative to the upper finger holes 34, the upper basket 20 may have one or more upper finger grips 38 extending from the upper sidewall structure 24 to enable removal of the upper basket 20 from engagement with the lower basket 50. Likewise, in addition to or as an alternative to the lower finger hole 64, the lower basket may have one or more lower finger grips 70 extending from the lower sidewall structure 24 to enable removal of the lower basket 50 from the drain basin 90. The lower finger grips 70 are preferably aligned with the upper finger grips 38 when the upper basket 20 and lower basket 50 are in nested relationship with each other.

The upper raised portion 30 and lower raised portion 60 may optionally be incorporated to accommodate domed drain sealing apparatus such as that shown at http://www-.guardiandrainlock.com that might be installed in the drainpipe 92 at the floor 94 of drain basin 90. The upper and lower raised portions 30 and 60 are illustrated as being domed but may be of any shape including for example a square or box shape.

The upper basket 20 and, lower basket 50 are configured so that when in the nested orientation with the peripheral flange 42 in place in the lower basket peripheral recessed ledge 72, the upper basket 20 will be in spaced orientation from the lower basket 50 defined by the first gap 80 therebetween. Finally, the lower basket 50 may be provided with one or more legs 74 to allow the assembled nested drain basket apparatus 10 to sit on the floor 94 of the drain basin 90.

In operation, the upper basket 20 is removably nested into the lower basket 50 with the nested drain basket apparatus 10 fitting into the drain basin 90 with the legs 74 resting on the drain basin floor 94 and the top of the nested drain basket apparatus 10 generally level with a floor 98 into which the drain basin 90 extends. The legs 74 provide a second gap 96 between the lower bottom 52 and the drain basis floor 94 with the nesting interconnection between the upper basket and the lower basket provided by the interconnection of the peripheral flange 42 in the recessed ledge 72 which also provides the first gap 80 between the upper bottom 22 of the upper basket 20 and the lower bottom 52 of the lower basket 50.

Figure 5:
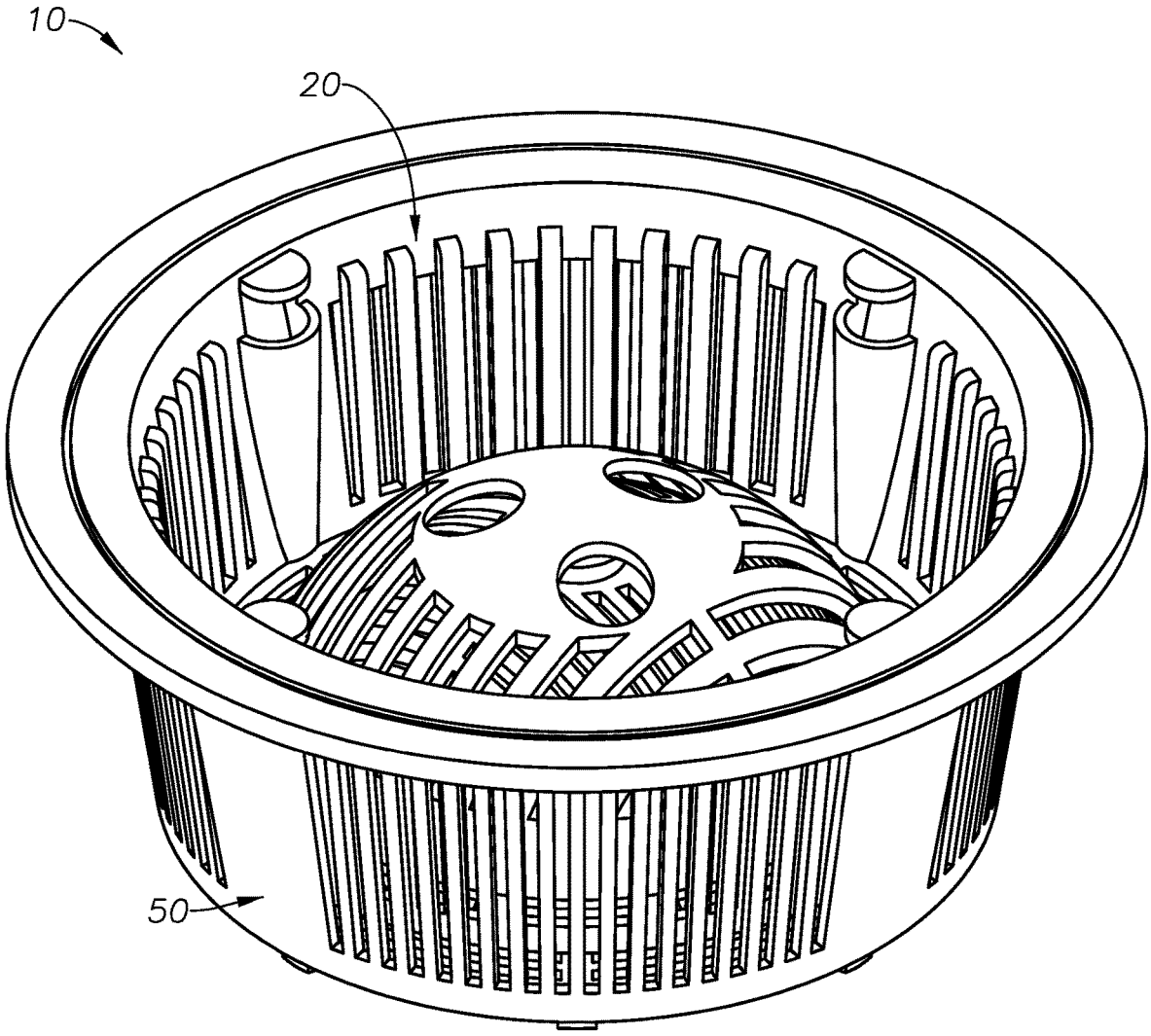
FIG. 5 is a perspective view of the assembled upper and bottom baskets of the nested drain baskets apparatus according to a round embodiment of the present disclosure.

Preferably, the nested drain basket assembly 10 is sized and shaped to fit into the drain basin 90 as described. For example, as illustrated in FIGS. 1-4, if the drain basin 90 is square and of a defined depth, the nested drain basket assembly 10 would also be square and sized to fit into drain basin 90 without unnecessary space between the peripheral edge of the basket apparatus and the upper edge of the drain basin 90, with the upper surface of the nested drain basket apparatus 10 being substantially level with the floor 98. This leveling can be accomplished by provided that the legs 74 be adjustable or have replaceable with legs of different heights. Other shapes are also possible such as round (as illustrated in FIG. 5), oval, rectangular or another any other shapes so that the nested drain basket apparatus 10 "fits" the shape of the drain basin 90.

When the upper basket is filled with debris, it can be removed by grasping the upper finger holes 34 in the center of the upper raised portion 30 leaving the lower basket 50 in place to continue to prevent debris from entering the drainpipe 92 while the debris in the upper basket 20 are appropriately removed and discarded.

Based on the above, it is evident that the apparatus comprising two baskets, one basket placed within another and each basket having holes might be used as filtering systems for collecting debris while allowing water to sift through the holes in each basket. The baskets are designed such that they can be removably positioned in the drain of a floor sink or basin. The first basket has a smaller number of larger holes and is configured to be inserted within the bottom basket, which has a larger number of smaller holes, and the first basket together with the second basket help in collecting debris while allowing water to sift through the holes. The two baskets act as a filtering system where larger debris is caught in the first basket with the larger holes while smaller debris is captured in the second basket with smaller holes. Due to the constructional features of both the first basket and the second basket, the first basket might be removed when the basin is filled by larger debris/sediment while still allowing the second basket to continue protecting the drain line.

Although it is explained considering that the apparatus comprises two baskets with holes, it is obvious to a person skilled in the art to provide more than two baskets having holes, which might be configured in a nested relationship for filtering out debris from the water while allowing water to sift through the holes.

Also, the shape, size and placement of each component shown in figures are provided for illustrative purpose only and should not be construed in limited sense. A person skilled in the art will appreciate alternate parts and/or mechanisms that might be used to implement the embodiments of the present invention and such implementations will be within the scope of the present invention.

What is claimed is:

1. A nested drain basket apparatus (10) for being positioned in a drain basin terminating in a drainpipe, which allows liquid to pass through the apparatus into the drainpipe while capturing debris in the liquid to prevent the debris from entering the drainpipe comprising:

An upper basket (20) having an upper bottom (22) and an upper sidewall structure (24) extending from the upper bottom (22), wherein at least one of the upper bottom (22) and the upper sidewall structure (24) have upper openings (36) therethrough and wherein the upper bottom (22) includes an upper raised portion (30); and a lower basket (50), having a lower bottom (52) and a lower sidewall structure (54) extending from the lower bottom (52) the lower bottom (52) including a lower raised portion (60), wherein at least one of the lower bottom (52) and the lower sidewall structure (54) having lower openings (58) therethrough, wherein the upper openings (36) are generally larger that the lower openings (58);

wherein the lower basket (50) and upper basket (20) are oriented in nested relationship to each other.

2. The nested drain basket apparatus of claim 1, wherein the upper raised portion (30) has upper openings (36) therethrough and the bottom raised portion has lower openings (58) therethrough.

3. The nested drain basket apparatus (10) of claim 1, wherein the upper sidewall structure terminates in a peripheral flange (42) projecting outwardly from upper sidewall structure (24) and wherein the lower sidewall structure terminates in a peripheral recessed ledge (72) projecting outwardly from the lower sidewall structure (54), the recessed ledge (72) configured for receiving the peripheral flange (42) for interconnecting the upper basket (20) within the lower basket (50) in the nested relationship.

4. The nested drain basket apparatus (10) of claim 1, wherein the upper raised portion (30) is provided with a plurality of upper finger holes (34) for enabling a user to grasp and remove the upper basket (20) from engagement with the lower basket (50).

5. The nested drain basket apparatus (10) of claim 4, wherein the lower raised portion (60) has a lower finger hole (64) in an offset orientation relative to the plurality of upper finger holes (34), wherein the lower finger hole (64) enables the removal of the lower basket (50) from the drain.

6. The nested drain basket apparatus (10) of claim 1, wherein the upper bottom (22) is provided with a plurality of upper finger holes (34) for enabling a user to grasp and removed the upper basket (20) from engagement with the lower basket (50).

7. The nested drain basket apparatus (10) of claim 6, wherein the lower bottom (52) has a lower finger hole (64) in an offset orientation relative to the upper finger holes (34).

8. The nested drain basket apparatus (10) of claim 1, further comprising at least one upper finger grip (38) in the upper sidewall structure (24) and at least one lower finger grip (70) in the lower sidewall structure.

9. The nested drain basket apparatus of claim 8 wherein each lower finger grip (70) is aligned with an upper finger grip (38) to facilitate nesting of the top basket in the lower basket.

* * * * *